US006820758B2

(12) United States Patent
May et al.

(10) Patent No.: US 6,820,758 B2
(45) Date of Patent: Nov. 23, 2004

(54) LOCK FOR KNOCK-DOWN STORAGE RACK

(75) Inventors: Trevor May, Oshawa (CA); Rolf Fabricius, Bowmanville (CA); Stephan Davis, Courtice (CA)

(73) Assignee: North American Steel Equipment Company Ltd., Ontario (CA)

( * ) Notice: Subject to any disclaimer, the term of this patent is extended or adjusted under 35 U.S.C. 154(b) by 0 days.

(21) Appl. No.: 10/125,406

(22) Filed: Apr. 19, 2002

(65) Prior Publication Data

US 2002/0153341 A1 Oct. 24, 2002

(30) Foreign Application Priority Data

Apr. 20, 2001 (CA) ..... 2344727
Sep. 7, 2001 (CA) ..... 2357068

(51) Int. Cl.[7] ..... A47B 47/00
(52) U.S. Cl. ..... 211/192; 248/222.11; 403/324; 403/327
(58) Field of Search ..... 211/192, 191, 211/190, 208; 248/220.22, 221.12, 221.11, 219.1; 403/326, 324, 321, 325; 70/DIG. 19, DIG. 20

(56) References Cited

U.S. PATENT DOCUMENTS 5,938,367 A 8/1999 Olson ..... 211/192
6,155,441 A 12/2000 Andersen et al. ..... 211/192
6,510,955 B2 * 1/2003 Pellegrino ..... 211/192
6,523,378 B2 * 2/2003 Kuo ..... 70/360

* cited by examiner

*Primary Examiner*—Peter M. Cuomo
*Assistant Examiner*—Erica B. Harris
(74) *Attorney, Agent, or Firm*—Birch, Stewart, Kolasch & Birch, LLP

(57) ABSTRACT

The locking connector interconnects a shelf-supporting beam to an upright of a knock-down storage rack. The locking connector includes a plunger which is connected to the connector and which is slidable between locking and unlocking positions. The plunger, when in the locking position, is within one of a number of openings formed in the upright with resulting locking of the upright to the connector. When the plunger is in the unlocking position, it is outside the opening thus allowing the upright to be separated from the connector. The first embodiment of the locking connector includes a resilient rod which is biased into a groove formed in the shank of the plunger when the plunger is in the locking position. The rod prevents the plunger from moving from the locking position unless a force, opposed to the bias of the rod, is applied to the plunger to cause the rod to withdraw from the groove. The second embodiment of the locking connector includes a housing which surrounds and protects the plunger. The third embodiment includes a guard for protecting the housing when the plunger is in the locking position.

16 Claims, 9 Drawing Sheets

LOCK FOR KNOCK-DOWN STORAGE RACK

BACKGROUND OF THE INVENTION

This invention relates to knock-down storage racks and more particularly to a locking connector for preventing the separation of the uprights from the shelves of a knock-down storage rack after they are interconnected.

Knock-down storage racks are well known and are in common use for storage in such places as warehouses, garages and basements. The racks are composed of columns or uprights and horizontal shelf-supporting beams. Usually the uprights have a number of spaced apart slots and the beams have teeth or studs. The beams are connected to the uprights by insertion of the teeth or studs into the slots of the uprights. The beams can be set at a desired level by appropriate choice of slots in which the teeth or studs are inserted.

Once the teeth or studs of the shelf-supporting beams are in the slots, the beams will remain secure so long as there is a downward force on the beams. Thus, if the beams are loaded, the storage rack will remain intact. If, however, an upward force is applied to the beams, the beams will separate from the uprights and the storage rack will come apart. It may also come apart when the beams are not loaded and a sideways force is applied to the rack.

Fork lift trucks are commonly used to load and unload heavy items on storage racks. Such items are usually placed on pallets so that there is space beneath them for the prongs of the fork lift. In unloading an item from the shelf-supporting beam, the operator of the truck may accidentally insert the prongs beneath the beam where the item is located and not into the pallet. When the operator lifts the prongs, the beam will rise with the load and the storage rack may come apart. When this happens, heavy items on the beams may fall onto the operator of the truck or any bystanders in the vicinity of the rack with resulting injury or, in extreme instances, death. Items on the rack may be also damaged in the fall.

It is known to provide locks for preventing the shelves from separating from the uprights once the storage rack is assembled. Examples of such locks are described in U.S. Pat. No. 5,938,367 and U.S. Pat. No. 6,155,441. Such locks frequently have a plunger which when activated, is within the same slot as a tooth or stud of a shelf where the plunger prevents the tooth or stud from withdrawing from the slot in the upright. The plunger is deactivated by withdrawing it from the slot so that the shelf may be separated from the upright.

A shortcoming of many such locks is that they are susceptible to accidental deactivation. Some, for example, become deactivated when they are rotated one quarter or one half turn. When such locks are accidentally struck, they may turn incrementally. If they are struck repeatedly, eventually they will rotate sufficiently to deactivate. Other locks are spring-loaded and activate and deactivate when they are pressed. They too can deactivate when accidentally struck.

Another shortcoming of such locks is that are susceptible to breakage if they are accidentally struck. In some cases, for example, the locks are held in position by tabs or ears which are riveted or welded in position. If such locks are accidentally struck by the prongs of a fork lift truck, the tabs may break off.

The locking connector of the subject invention resists deactivation when accidentally struck. The locking connector can only be opened or deactivated by means of a relatively large force. Preferably a tool such as a screw driver is required to apply such a force and in that case, the locking connector will not open unless an operator has such a tool and he uses it deliberately to open the connector. Accordingly a storage rack equipped with such a locking connector will not come apart should it be accidentally struck or should its shelf-supporting beams be accidentally raised when items are being unloaded from them.

The locking connector of the invention also resists breakage when struck. The locking connector, according to one embodiment, is contained within a housing which protects the locking connector. Hard blows may damage the housing but are unlikely to damage the lock.

SUMMARY OF THE INVENTION

Briefly, the locking connector of my invention interconnects a shelf-supporting beam and an upright of a knock-down storage rack. The locking connector is fixed to the beam and is removably connected to the upright. The locking connector has a plunger which is slidable between locking and unlocking positions. The plunger has a shank in which a recess is formed and which, when in the locking position, is within one of a number of openings formed in the upright with resulting locking of the upright to the connector. When the plunger is in the unlocking position, the shank is outside the opening thus allowing the upright to be separated from the connector. The lock includes a retainer which is biased by resilient means into the recess when the plunger is in the locking position and prevents the plunger from moving from the locking position unless a force, opposed to the bias of the retainer, is applied to the plunger to cause the retainer to withdraw from the recess.

A second embodiment of the locking connector has an outer wall having oppositely facing inner and outer surfaces and an aperture which is defined by an edge of the front wall. A casing extends outwardly from the front wall and has an inner end in which a groove is formed for receipt of the edge such that the margin of the front wall adjacent to the edge are within the groove. A plunger is confined within the casing and is slidable between a locking position in which the plunger extends though the aperture and one of the openings in the upright with resulting locking of the locking connector to the upright and an unlocking position in which the plunger is outside the opening. The locking connector has resilient means which biases the plunger into the locking position and which opposes movement of the plunger from the locking position unless a force, opposed to the bias of the resilient means, is applied to the plunger to cause the plunger to withdraw from the opening

DESCRIPTION OF THE DRAWINGS

Three embodiments of the locking connector of the invention are described with reference to the accompanying drawings in which:

In FIG. 7 the plunger is in the locked position and in FIG. 8 the plunger is in the unlocked position.

Like reference characters refer to like parts throughout the description of the drawings.

DESCRIPTION OF PREFERRED EMBODIMENTS OF THE INVENTION

Figure 1:
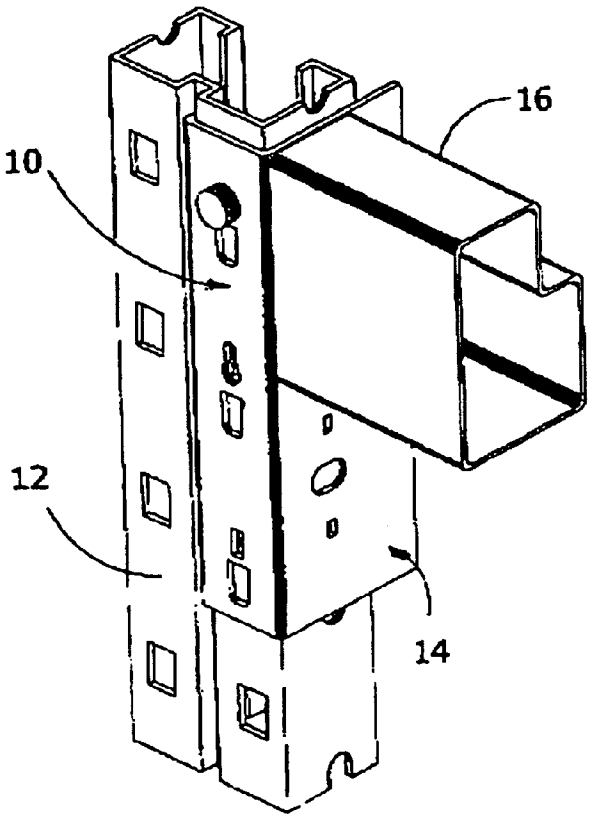
FIG. 1 is a perspective view of the locking connector, a shelf-supporting beam and an upright of a knock-down storage rack.

With reference to FIG. 1, the locking connector of the invention, generally 10, is shown in conjunction with an upright 12 of a conventional knock-down storage rack, generally 14. The locking connector serves to connect the upright to a shelf-supporting beam 16. The locking connector is permanently connected to the beam by such means as welding while the locking connector is removably connected to the upright in the manner described below.

Figure 2:
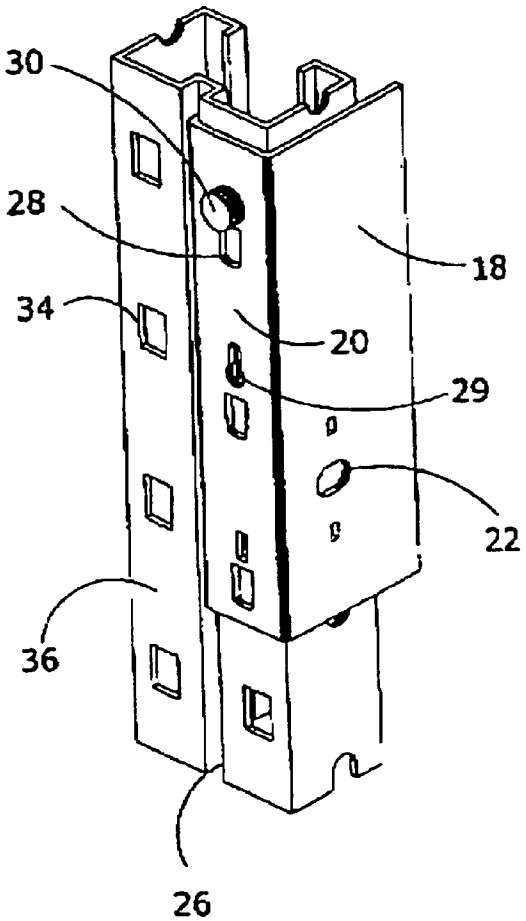
FIG. 2 is a perspective view of the locking connector and an upright.
Figure 3:
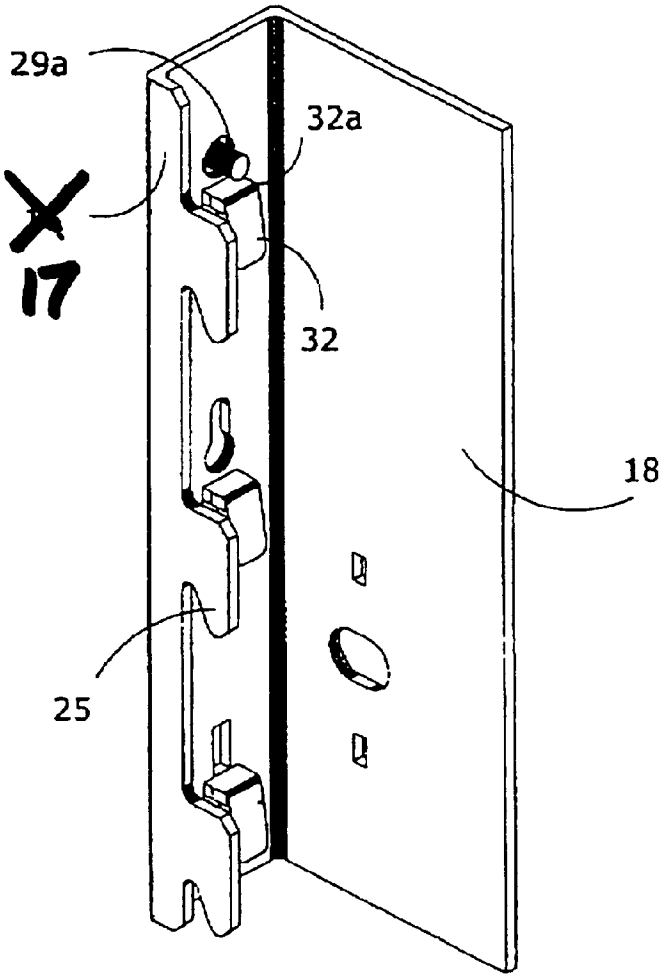
FIG. 3 is a perspective view of the locking connector from the side opposite that shown in FIGS. 1 and 2.

With reference to FIGS. 2 and 3, the locking connector has inner and outer side walls 17, 18 spaced apart by a front wall 20. The outer side wall has an opening 22 for receipt of a bolt for interconnecting the locking connector to the upright. The bold adds rigidity to the storage rack, when assembled, should that be desirable The inner side wall of the locking connector has a number of teeth or hooks 25 spaced along its inside edge. The inner wall is received in a groove or channel 26 that divides the upright into two parts, one for connection to beam 16 and the other to a like beam that extends outwardly from the opposite side of the upright.

The locking connector has a number of generally retangular openings 28 on its front wall 20. Above each opening is a smaller aperture 29, the uppermost 29*a* of which receives plunger 30. On the inside surface of the front wall, tabs 32 extend horizontally outwardly at 32*a* from the upper edge of each opening 28 then downwardly.

Figure 4:
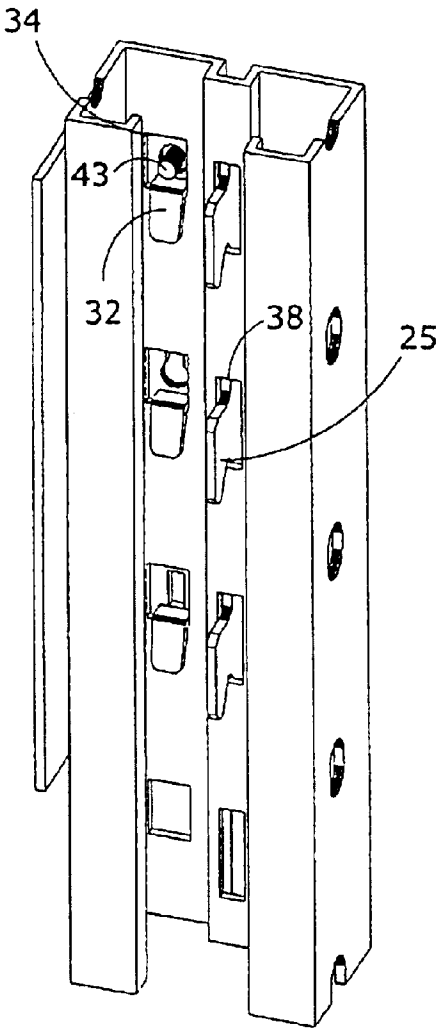
FIG. 4 is a perspective view of the locking connector and upright from the side opposite that shown in FIG. 2.

With reference to FIGS. 2 and 4, vertically spaced openings 34 are formed in the front faces 36 of the upright. Openings 38 are also formed in the channel for receipt of teeth 25 of the locating connector.

Figure 6:
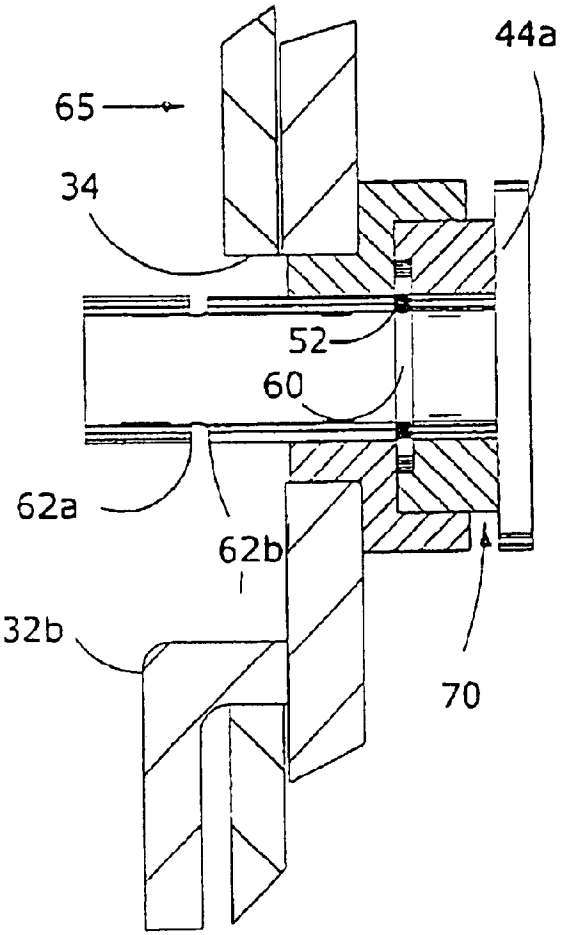
FIG. 6 is another perspective view of the plunger in a locked position.
Figure 5:
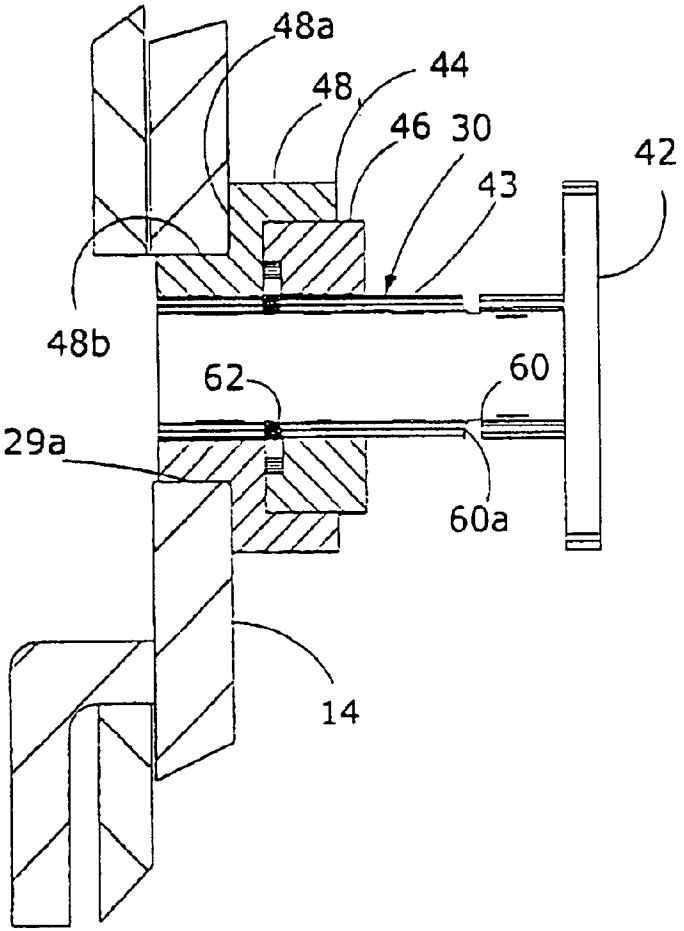
FIG. 5 is a perspective view, partly in section and in enlarged scale, of the plunger of the locking connector in a deactivated or unlocked position.

With reference to FIGS. 5 and 6, plunger 30 has a head 42 at the outer end of a shank 43. The shank is slidingly mounted in a bushing 44 which consists of inner and outer concentric cylinders 46, 48. The outer cylinder has an outer wall which is stepped cross-axially inward at 48*a*. The stepped-in area 48*b* is received in aperture 29*a* of the locking connector and is secured therein by means of a pressure fit. The two cylinders which make up the bushing are held together by a pressure fit and remain together by friction.

Figure 8:
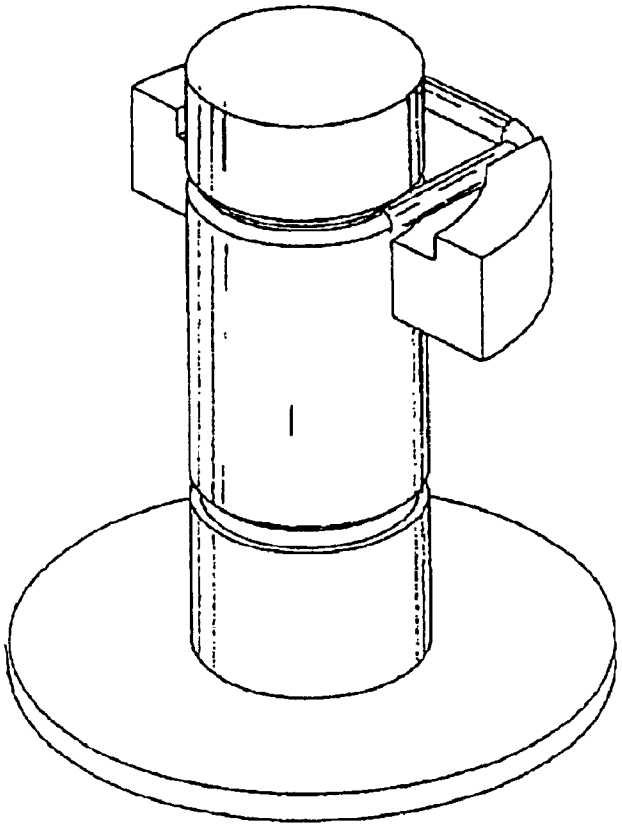
FIGS. 7 and 8 are perspective views of portions of the plunger.
Figure 7:
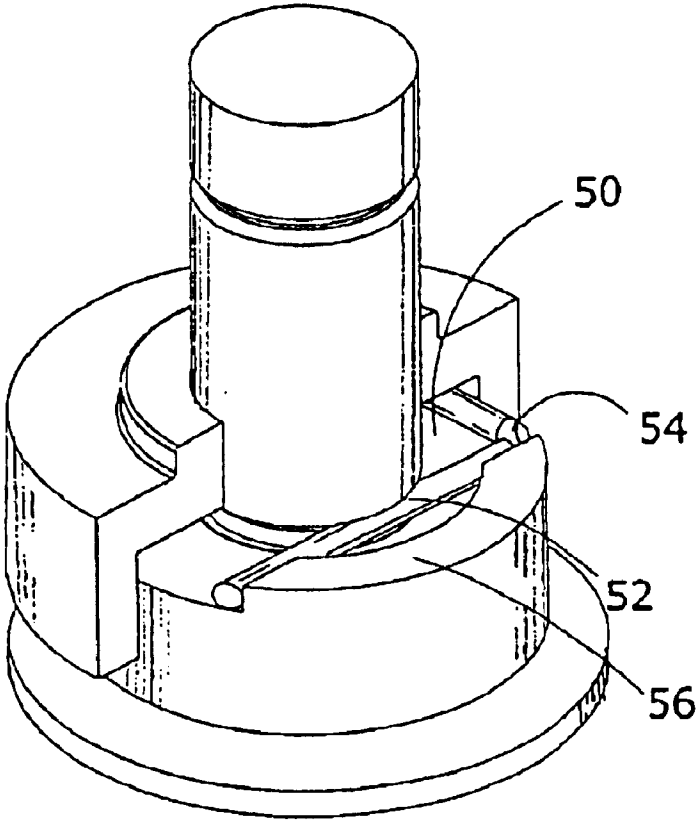

With reference to FIGS. 7 and 8, the inner cylinder has an annular cavity 50 in which a rod or retainer 52 is received. The rod is confined in the cavity by means of a raised portion 54 of the inner cylinder. The upper surface 56 of the raised portion contacts the cross-axially extending lower surface 58 of the outer cylinder 48 so that the rod is confined within the cavity. The rod is normally straight but resiliently deforms to a curved shape when it is within the groove.

With reference again to FIG. 5, the outer wall of shank 43 has a pair of spaced outer and inner annular recesses or grooves 60, 62. The rod is received in inner groove 62 when the plunger is in the unlocking positions as illustrated in FIG. 5, and in outer groove 60 when the plunger is in the locking positions as illustrated in FIG. 6.

With reference to FIG. 6, the plunger is in the locking position when the shank projects through opening 34 of the upright and its head contacts the outer wall 44*a* of the bushing. Rod 52 is within outer groove 60 and prevents the plunger from being withdrawn from the bushing in the direction of arrow 65 unless an outward force applied to the head of the plunger. The inner side wall or cross-axially extending wall 60*a* of the groove is beveled or chamfered, as illustrated in FIG. 5, so that outward force is applied to the head will cause the rod to rise in the groove and withdraw from it. When it does so, the plunger can be drawn outwardly in the direction of the arrow.

When the plunger reaches the point illustrated in FIG. 5, the rod will enter inner groove 62. That groove serves as a stop point and prevents further outward movement of the plunger. That is because the groove has an inner side wall or cross-axially extending wall 62*a* which is flat and unleveled, as illustrated in FIG. 6. That wall prevents the rod from withdrawing from the groove when further outward force is applied to the plunger.

The side wall 62*b* of the inner groove opposite that of wall 62*a* is bevelled so that if the plunger is pushed inward from the position illustrated in FIG. 5, the rod will withdraw from the groove and allow the plunger to slide to the locking position illustrated in FIG. 6.

The means by which the plunger serves to lock the connector to the upright is best seen in FIG. 4. In that Figure, tabs 32 and teeth 25 are in openings 34 and 38 respectively of the upright and serve to prevent the connector from separating from the upright unless the connector is lifted. Lifting is resisted since there is little if any space between the shank of the plunger and the upper edge of opening 34. FIGS. 4 and 6 illustrate this. Only when the plunger is removed from opening 34 can the locking connector be lifted and separated from the upright.

The rod is composed of resilient material such as spring steel so that it will yield to allow the rod to withdraw from the grooves. However the material of the rod is chosen such that the rod does not yield in this manner unless a comparatively large outward force is applied to the plunger.

Preferably, the force sufficient for this purpose can only be applied by means of a prying tool, such as a screw driver. With reference to FIG. 6, to apply such force, the prying edge of the tool must be inserted in the space 70 between the head and the facing wall of the outer cylinder of the bushing. The tool must be moved back and forth to pry the head outward. The rod should preferably be sufficiently stiff or inflexible that it does not allow the head to be removed by means of a force that is normally possible by a human hand unaided by a tool. As a result, the plunger cannot be accidentally removed.

Accordingly, the plunger can only be removed by means of a screw driver or other prying tool intentionally inserted in space 70 and deliberately moved in a way that will cause the plunger to move outward.

Figure 9:
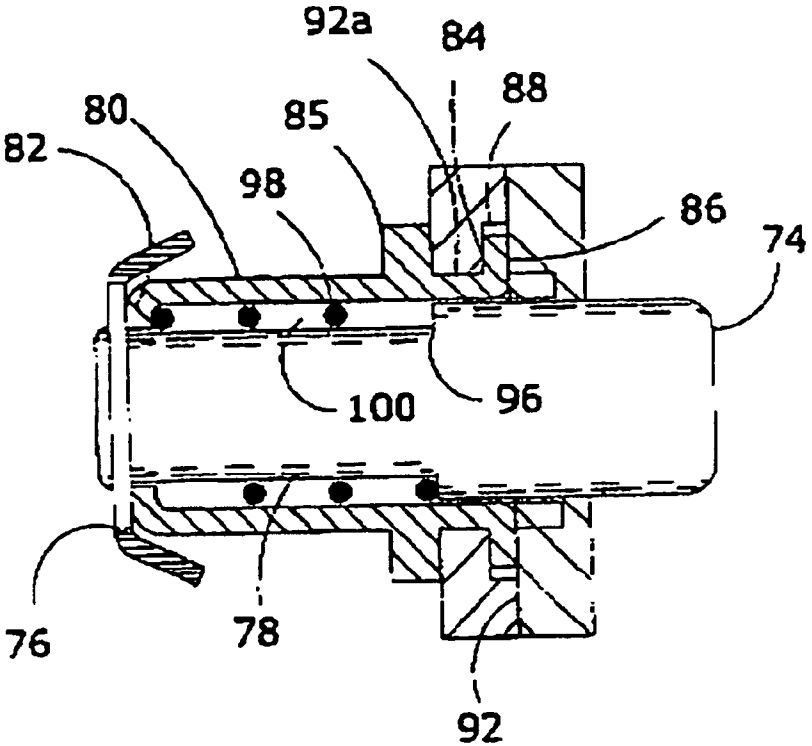
FIG. 9 is a perspective view, partly in section, of the plunger of a second embodiment of the locking connector in a activated or locked position.

With reference to FIG. 9, plunger 74 has a head or cap 76 at the outer end of a shank 78. The shank is slidingly mounted in a hollow cylindrical casing 80.

The casing has an outer end defined by a cross-axially inwardly extending neck 82 and an inner end in which a groove 84 is formed. The groove is defined by two annular ridges 85, 86 on the outer wall of the casing. The innermost ridge 86 is formed by bending the inner end of the casing wall outward. until it is within an annular recess 88 in the front wall 92 of the locking connector.

Recess 88 is provided so that the innermost surface of the casing is flush with the inner surface of the front wall of the casing. The connector will accordingly contact the upright squarely and will not wobble when it is attached to the upright.

As illustrated in FIG. 9, groove 84 receives the margin 92*a* of the front wall adjacent to the aperture. The two ridges of the casing press firmly against the margin so that the casing is securely connected to the front wall.

Shank 78 is stepped cross-axially outward approximately midway of its ends by an annular wall 96. Resilient means in the form of a coil spring 98 is received in space 100 defined, at its ends, by neck 82 and by wall 96, and by the inner wall of the casing and the outer wall of the shank. The spring biases the plunger to the activated or locked position illustrated in FIG. 9. In that position the inner end of the shank projects through the opening in the upright.

Figure 10:
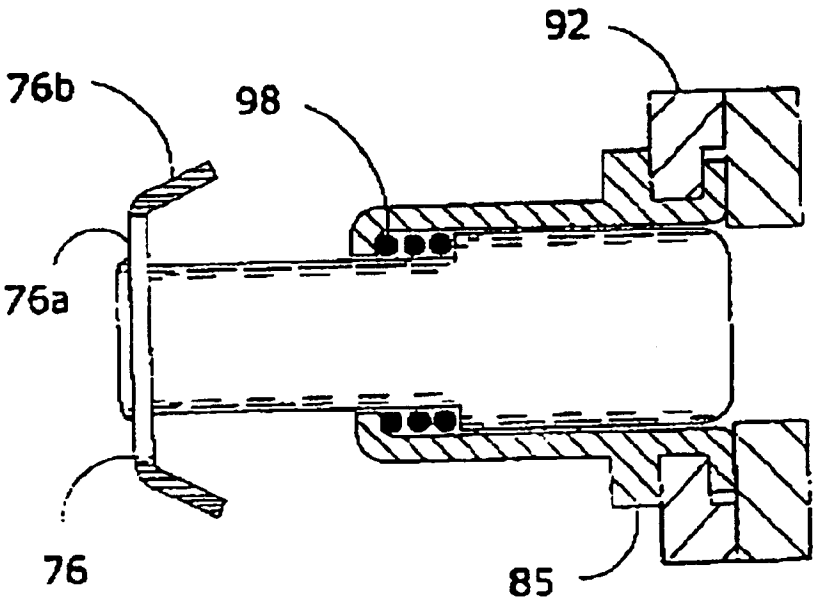
FIG. 10 is another perspective view of the plunger illustrated in FIG. 9 in an unlocked or deactivated position.

With reference to FIG. 10, the plunger is de-activated or unlocked by grasping head 76 and pulling it outward to the position illustrated in that Figure. The inner end of the shank is then fully withdrawn from the opening in the upright.

In some cases, it may not be desirable that the plunger be unlocked or deactivated simply by pulling its head outward. In such cases, the coil spring should be sufficiently strong to resist such pulling but not strong enough to resist prying. To facilitate prying, the head has a somewhat hollow hemispheric cross-section. The central portion 76*a* is generally flat while the peripheral portion 76*b* extends radially outward and toward the locking connector. As illustrated in FIG. 9, there is no space between the central portion 76*a* of the head and the neck since the two are in contact with each other. There is however a space between the peripheral portion and the casing. That space is sufficient large to receive a prying instrument such as a screw driver so that the plunger can be pried open by this means.

Figure 12:
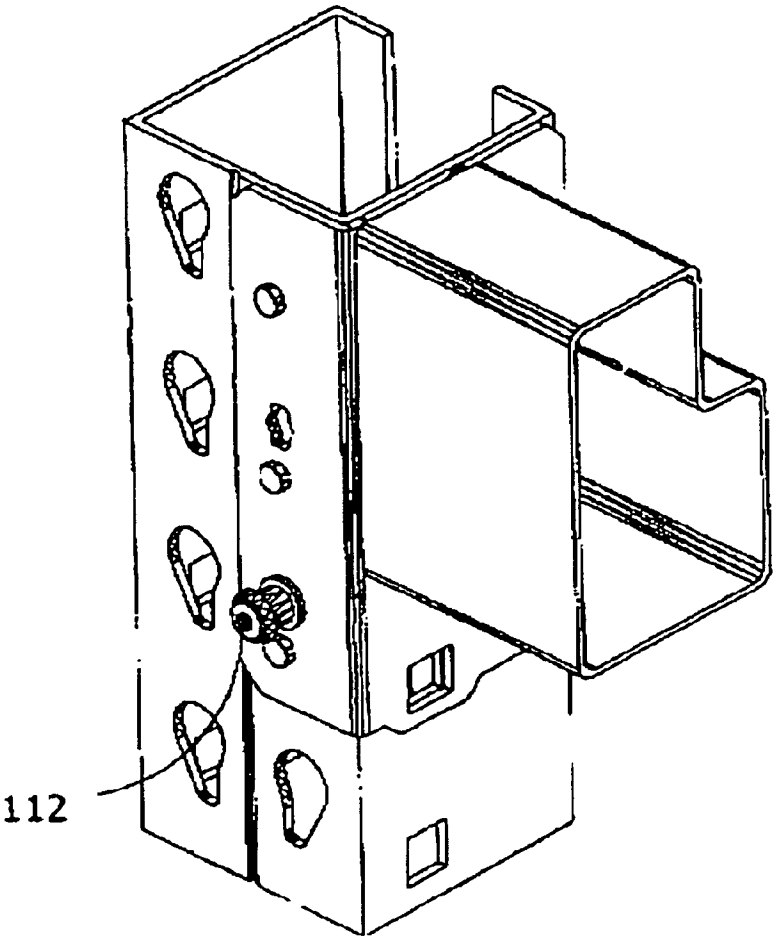
FIG. 12 is a perspective view of the locking connector of FIG. 9 in conjunction with an upright and a beam.
Figure 11:
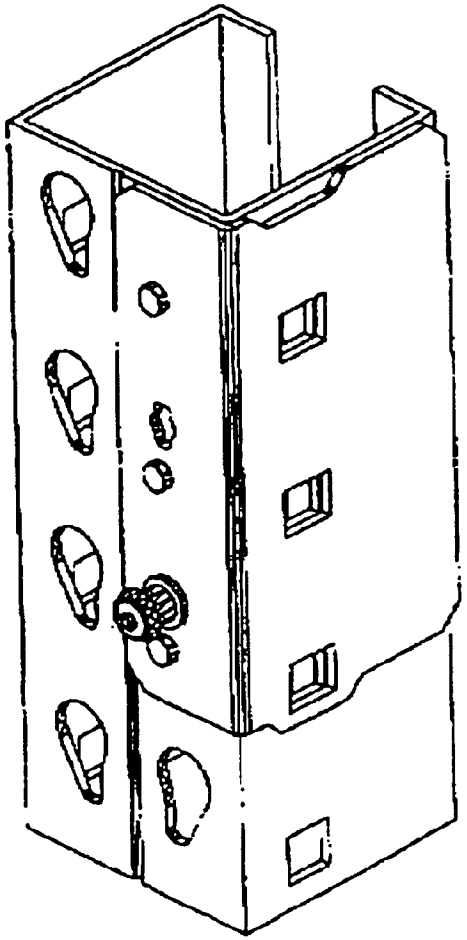
FIG. 11 is a perspective view of the locking connector of FIG. 9 in conjunction with an upright.
Figure 13:
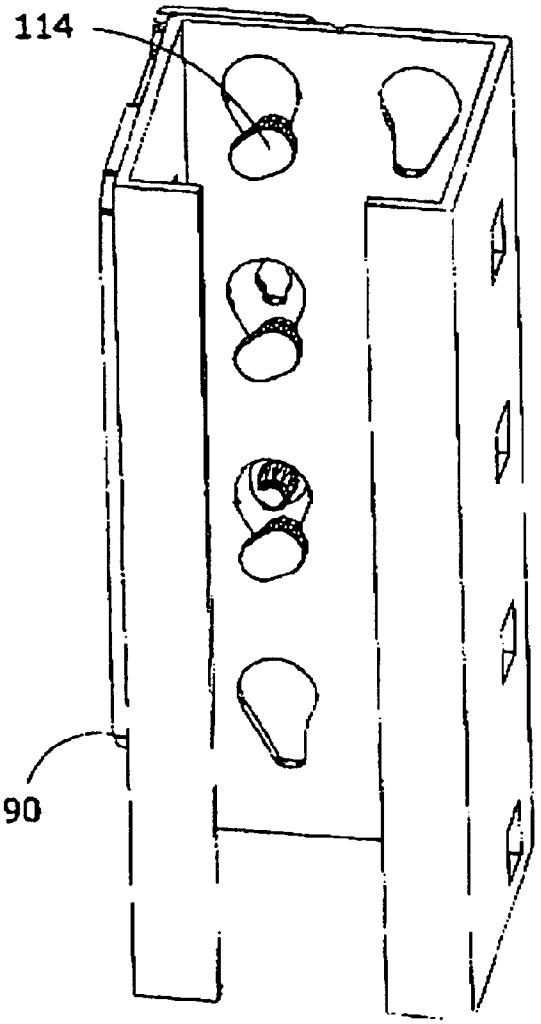
FIG. 13 is a perspective view of the locking connector of FIG. 9 and an upright, from the rear.

With reference to FIGS. 11 to 13, a rivet 112 is beneath the plunger and extends through an opening in the locking connector and terminates at a cylindrical head 114 located on the inner surface of the locking connector as illustrated in FIG. 13. The rivet head serves the same purpose as tab 32 illustrated in FIG. 3.

The second embodiment of the locking connector has a number of significant advantages: first the plunger can be retracted by hand and can, as a result, be connected and disconnected quickly. This is to be contrasted with plungers where special tools or a significant force is required to open them. Secondly the plunger can be constructed of materials of sufficient strength that it will not break when struck violently. When the plunger is struck by a fork lift truck, for example, the plunger will not open.

Figure 15:
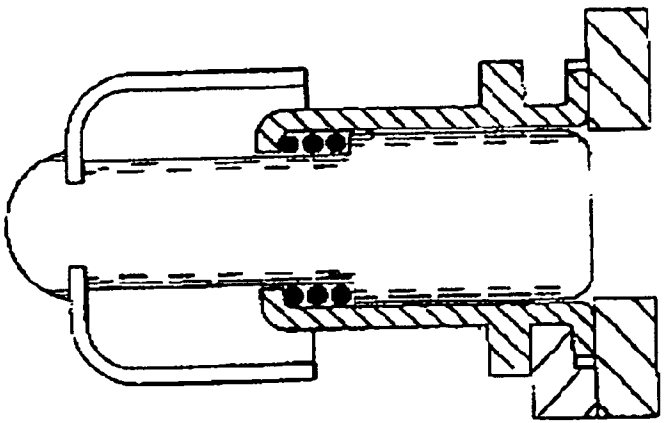
FIG. 15 is a perspective view of the plunger of FIG. 14 in an unlocked position.
Figure 14:
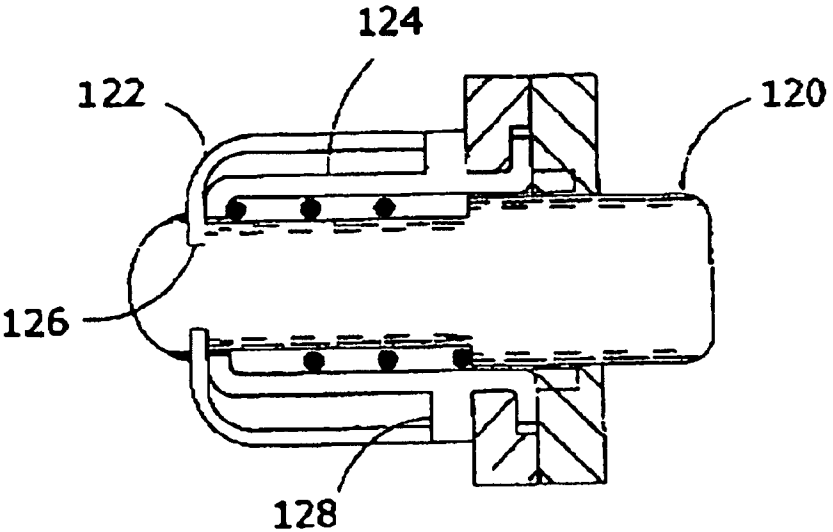
FIG. 14 is a perspective view of the plunger of a third embodiment of the locking connector, in a locked position.

With reference to FIGS. 14 and 15, plunger 120 has the same construction as the plunger illustrated in FIGS. 9 and 10 except that it lacks a head. Instead, a hollow cylindrical guard 122 surrounds casing 124 when the plunger is in the locking position illustrated in FIG. 14. The guard serves both as a handle for opening and closing the plunger and as protection for the plunger should it be accidentally struck.

The guard is concentrically disposed about the casing and the plunger. The outer end of the guard is received in an annular groove 126 in the plunger. The inner end of the guard contacts ridge 128 of the casing.

FIG. 15 illustrates the plunger when it is in an unlocking position. In that position the lower portion of the casing is exposed and not protected by the guard. However the casing should not require protection at that time because it is only unlocked when it is being manually opened. Accidental impact of the plunger is unlikely to occur at such time.

It will be understood of course that modifications can be made in the preferred embodiment of the locking connector illustrated and described herein without departing from the scope and purview of the invention as defined in the appended claims.

We claim:

1. A locking connector for a knock-down storage rack having a plurality of horizontally spaced uprights and vertically spaced shelf-supporting beams, said uprights having a plurality of vertically spaced openings formed therein, said locking connector including: means for interconnecting said locking connector and one said beam; a plunger having a shank in which a recess is formed, said plunger being slidable between a locking position in which said shank is within one of said openings with resulting locking of said upright to said locking connector and an unlocking position in which said shank is outside said one opening; and a retainer biased by resilient means into said recess when said plunger is in said locking position and preventing movement of said plunger from said locking position unless a force, opposed to the bias of said retainer, is applied to said plunger to cause said retainer to withdraw from said recess.

2. The locking connector as claimed in claim 1 wherein said shank is cylindrical and said recess is an annular groove.

3. The locking connector as claimed in claim 1 wherein said retainer is a resilient rod.

4. The locking connector as claimed in claim 1 wherein said locking connector has a bushing which has a bore within which said shank is slidingly received and which has a cavity for receipt of a portion of said retainer.

5. The locking connector as claimed in claim 4 wherein said bushing has an outer wall, part of which contacts said head when said plunger is in said locking position and part of which is spaced apart from said head, said plunger being movable from said locking position by forcing a prying tool between said head and said outer wall to cause said head and said spaced apart outer wall to separate.

6. The locking connector as claimed in claim 1 wherein said recess is partly defined by a pair of spaced side walls, one of which being beveled for allowing said retainer to withdraw from said recess when a force is applied in a direction that will cause said plunger to move from said locking position to said unlocking position, the other of said walls being generally planar and preventing said retainer from withdrawing from said recess when a force is applied to said plunger in the opposite said direction whereby said plunger remains connected to said locking connector.

7. The locking connector as claimed in claim 6 wherein said shank has a second recess for receipt of said retainer when said plunger is in said unlocking position, each of said recesses being partly defined by a pair of spaced side walls, one of which being beveled for allowing said retainer to withdraw from said recess when a force is applied in a direction that will cause said plunger to move between said locking and unlocking positions, the other of said walls being generally planar and preventing said retainer from withdrawing from said recess when a force is applied to said plunger in the opposite said direction whereby said plunger remains connected to said locking connector.

8. The locking connector as claimed in claim 7 wherein said locking connector further has a tab removably receivable in said one opening for interconnecting said locking connector to said one upright.

9. A locking connector for a knock-down storage rack having a plurality of horizontally spaced uprights and vertically spaced shelf-supporting beams, said uprights having a front face in which a plurality of vertically spaced openings are formed, said locking connector including:

(i) interconnecting means for attaching said locking connector to one said beam;

(ii) a front wall having oppositely facing forward and rear faces and an aperture formed therein, said aperture being defined by an edge;

(iii) a hollow cylinder casing having an outer wall from which a pair of spaced apart ridges extend generally diametrically outwardly therefrom, said ridges defining opposite sides of a groove in which a portion of said edge is received such that a portion of said forward face contacts one said ridge and a portion of said rear face contacts the other said ridge, said forward and rear faces being clamped between said ridges;

(iv) a plunger confined within said casing and slidable between a locking position in which said plunger extends through said aperture and one of said openings in said upright with resulting locking of said locking connector to said upright and an unlocking position in which said plunger is outside said one opening; and (v) resilient means for biasing said plunger into said locking position and opposing movement of said plunger from said locking position unless a force, opposed to the biased of said resilient means, is applied to said plunger to cause said plunger to withdraw from said opening.

10. The locking connector as claimed in claim 9 wherein said resilient means is a coil spring.

11. The locking connector as claimed in claim 10 wherein said plunger has inner and outer ends and a cylindrical side wall which extends between said ends, said side wall being stepped cross-axially inward by an annular wall such that the cross-section of said plunger at its outer end is less than the cross-section at its inner end, said coil spring being confined in an annular space defined, at its ends, by said annular wall, and an outer end of said casing.

12. The locking connector as claimed in claim 11 wherein said plunger has a head at said outer end, said head having a central portion which is connected to said plunger and an outer portion which extends toward said front wall.

13. The locking connector as claimed in claim 12 wherein said head is hollow and hemispheric in shape.

14. The locking connector as claimed in claim 12 wherein said casing is cylindrical and hollow and is concentrically disposed about said plunger, said groove being annular and the edge of said aperture being circular and being within said groove throughout its entire length.

15. The locking connector as claimed in claim 14 further including a hollow cylindrical guard which is connected to said plunger and which surrounds said casing when in said locking position, said guard being concentrically disposed about said casing.

16. The locking connector as claimed in claim 9 further including a guard which is connected to said plunger and which surrounds said casing when in said locking position.

* * * * *